US005363721A

United States Patent [19]

Hsiao

[11] Patent Number: 5,363,721

[45] Date of Patent: Nov. 15, 1994

[54] BICYCLE PEDAL CRANK DISMOUNTING DEVICE

[76] Inventor: Chia-Yuan Hsiao, No. 4, Lane 11, Tze-Chiang St., Tu-Cheng City, Taipei Hsien, Taiwan, Prov. of China

[21] Appl. No.: 110,518

[22] Filed: Aug. 23, 1993

[51] Int. Cl.[5] ..... G05G 1/14

[52] U.S. Cl. ..... 74/594.1; 29/239; 29/426.1; 29/525.1; 81/436

[58] Field of Search ..... 74/594.1; 29/264, 239, 29/426.1, 426.5, 426.6, 434, 525.1; 81/436; 254/18, 199

[56] References Cited

U.S. PATENT DOCUMENTS

| | | | |
|---|---|---|---|
| 1,753,780 | 4/1930 | Fisher | 29/264 X |
| 3,740,814 | 6/1973 | Marshall | 29/264 |
| 5,170,548 | 12/1992 | Ramirez | 29/264 |
| 5,233,741 | 8/1993 | Maynard | 29/264 X |

FOREIGN PATENT DOCUMENTS

| | | | |
|---|---|---|---|
| 218721 | 11/1956 | Australia | 29/264 |

*Primary Examiner*—Charles A. Marmor
*Assistant Examiner*—Peter T. Kwon
*Attorney, Agent, or Firm*—Morton J. Rosenberg; David I. Klein

[57] ABSTRACT

A bicycle pedal crank dismounting device for dismounting a bicycle pedal crank, comprised of a hollow screw member and a stop rod, the screw member having a hexagonal hole on one end, an expanded bottom hole on an opposite end, and an inner thread linked between, the stop rod being fastened in the expanded bottom hole on the screw member by a C-shaped retainer ring, whereby the crank is dismounted by driving the screw member into the crew hole on the crank with the stop rod stopped against the bottom bracket bearing axle after the crank lock screw was removed, and then driving the crank lock screw into the inner thread of the screw member to turn the crank out of the bottom bracket bearing axle in the reversed direction.

1 Claim, 8 Drawing Sheets

BICYCLE PEDAL CRANK DISMOUNTING DEVICE

BACKGROUND OF THE INVENTION

The present invention relates to a device for dismounting the cranks from the bottom bracket bearing axle of a bicycle.

Conventionally, the procedure to dismount the crank of a bicycle pedal from the bottom bracket bearing axle is not so easy. As illustrated in FIGS. 1, 1A, 1B, 1C, and 1D, the crank is dismounted by: using a L-shaped hexagon wrench to remove the crank lock screw from the crank and the bottom bracket bearing axle of the bottom bracket, then using a spanner to turn the hexagonal head of a hollow, internally threaded screw element so as to drive the outer thread of the hollow, internally threaded screw element into the screw hole on the crank, and then using the spanner to drive a socket head screw rod into the inner thread of the screw element so as to turn the crank away from the bottom bracket bearing axle in the reverse direction.

The aforesaid procedure is complicated because at least two spanning tools must be used. Because the outer thread of the socket head screw rod must be sufficient for turning the crank out of the bottom bracket bearing axle, the socket head screw rod can not be shortened. Therefore, it is inconvenient to carry the elongated socket head screw rod and at least two spanning tools.

SUMMARY OF THE INVENTION

The present invention eliminates the aforesaid disadvantages. It is therefore the principal object of the present invention to provide a bicycle pedal crank dismounting device which allows the crank of a bicycle pedal to be conveniently dismounted from the bottom bracket bearing axle by using a single spanning tool. It is another object of the present invention to provide a bicycle pedal crank dismounting device which does not occupy much installation space.

According to the preferred embodiment, the bicycle pedal crank dismounting device is comprised of a hollow screw member and a stop rod. The screw member has a hexagonal hole on one end, an expanded bottom hole on an opposite end, and an inner thread linked between. The stop rod is fastened in the expanded bottom hole on the screw member by a C-shaped retainer ring. Therefore a single L-shaped hexagonal wrench can be used to dismounting the crank by: removing the crank lock screw from the screw hole of the crank, then driving the screw member into the crew hole on the crank with the stop rod stopped against the bottom bracket bearing axle, and then driving the crank lock screw into the inner thread of the screw member to turn the crank out of the bottom bracket bearing axle in the reversed direction.

DETAILED DESCRIPTION OF THE PREFERRED EMBODIMENT

Figure 1:
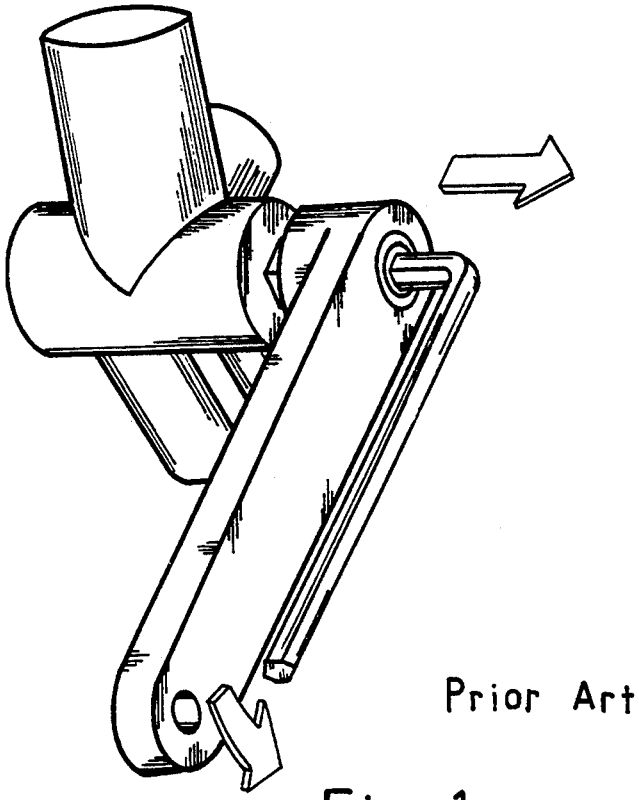
FIGS. 1, 1A, 1B, 1C, and 1D illustrate a series of steps in dismounting the crank of a bicycle pedal from the bottom bracket bearing axle according to the prior art.
Figure 1A:
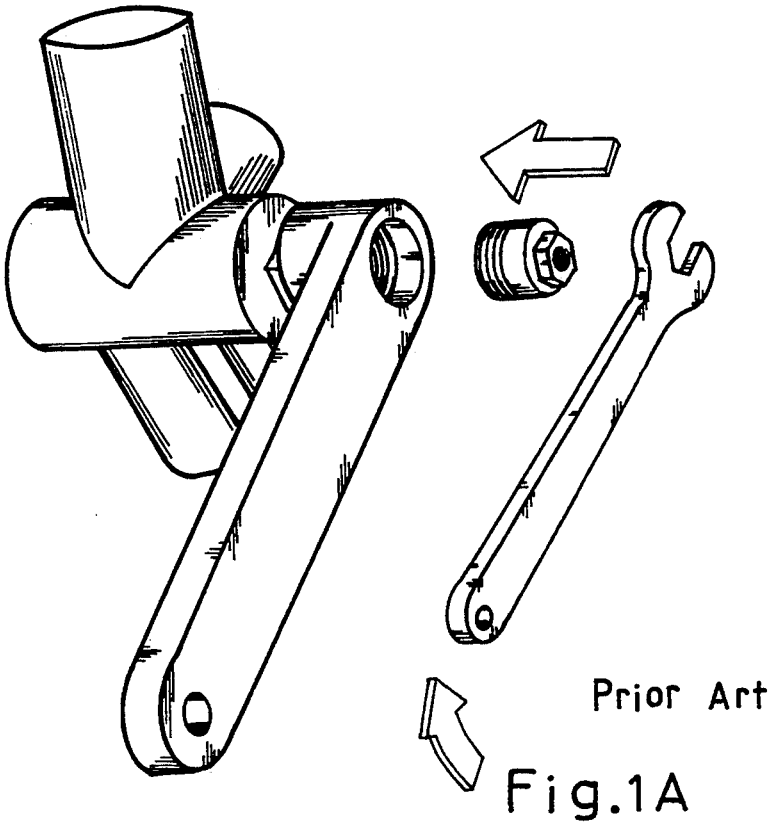
Figure 1B:
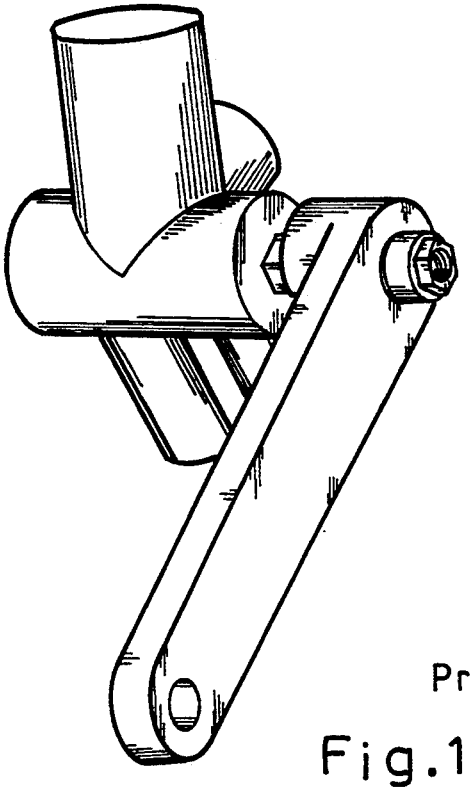
Prior Art Fig.1B
Figure 1C:
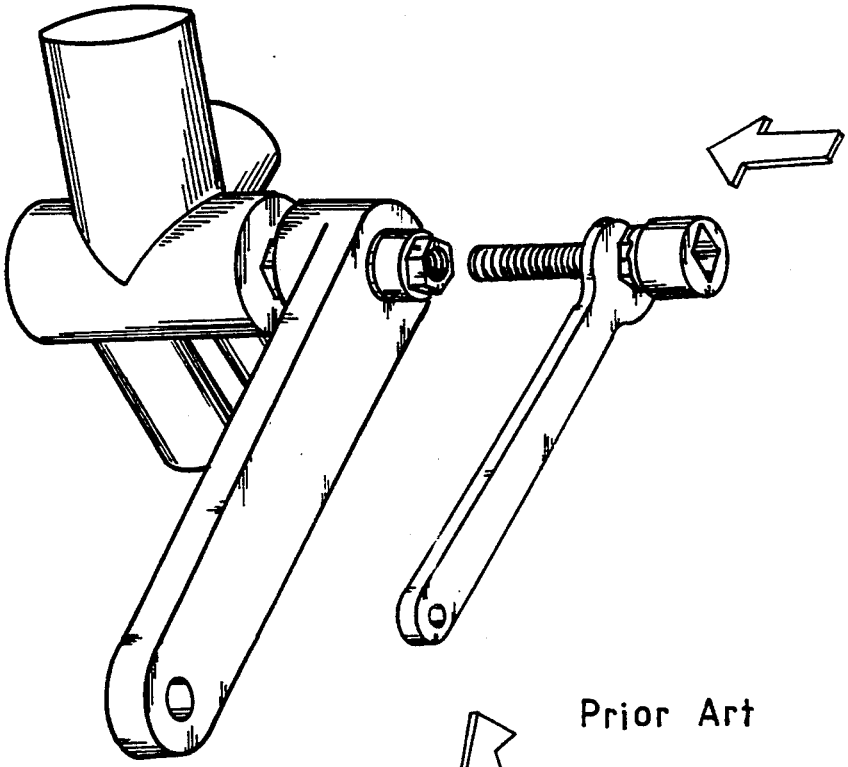
Prior Art Fig.1C
Figure 1D:
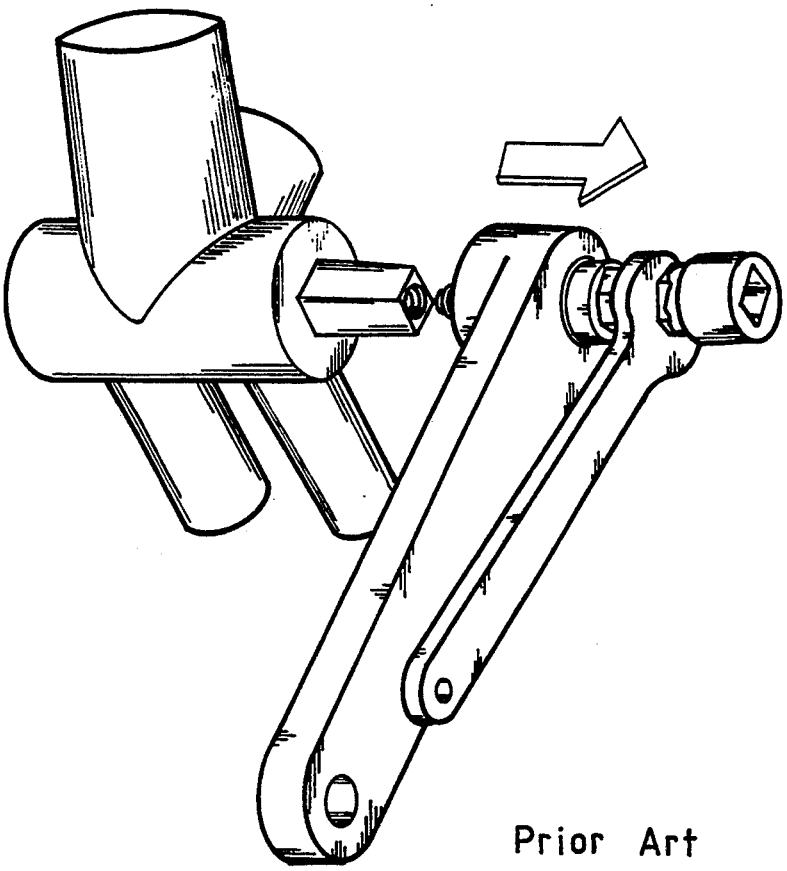
Figure 2:
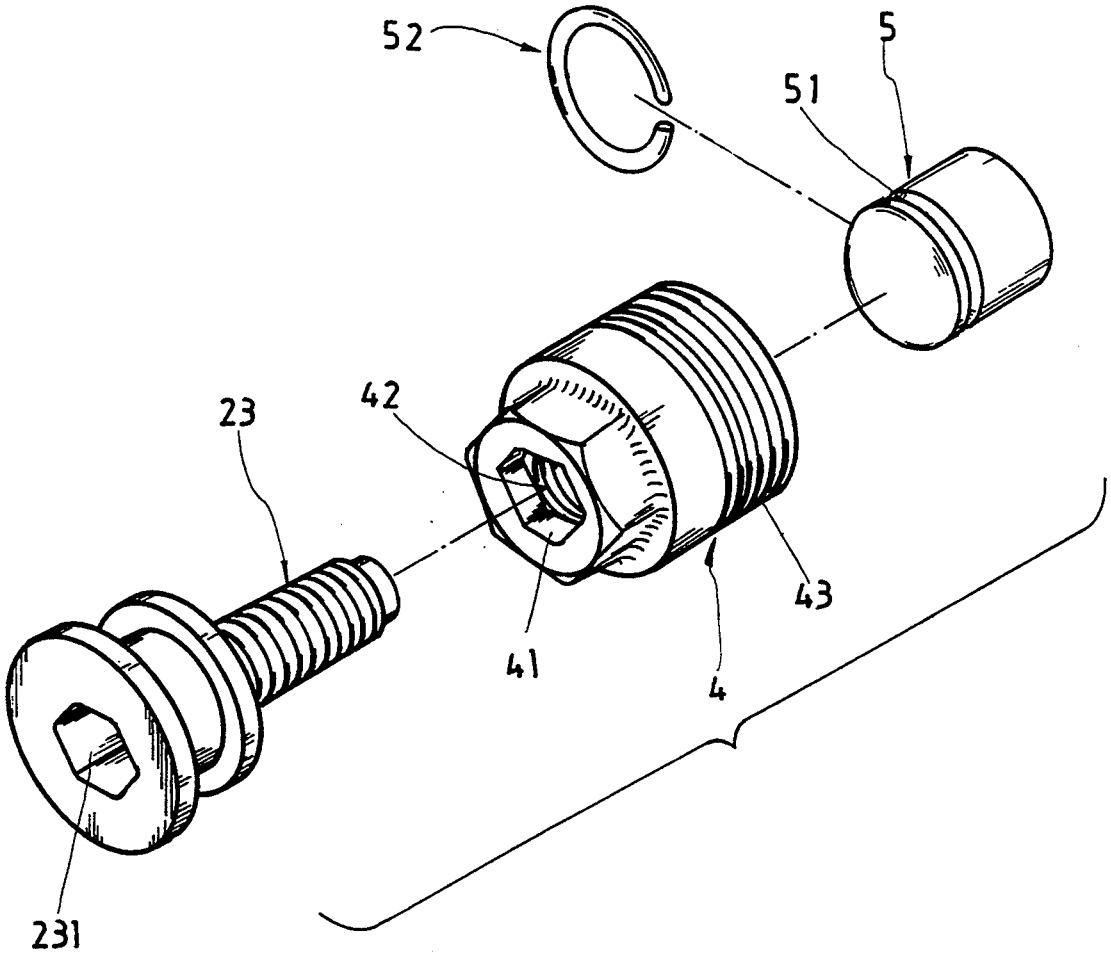
FIG. 2 is an exploded view of the bicycle pedal crank dismounting device of the preferred embodiment of the present invention.
Figure 3:
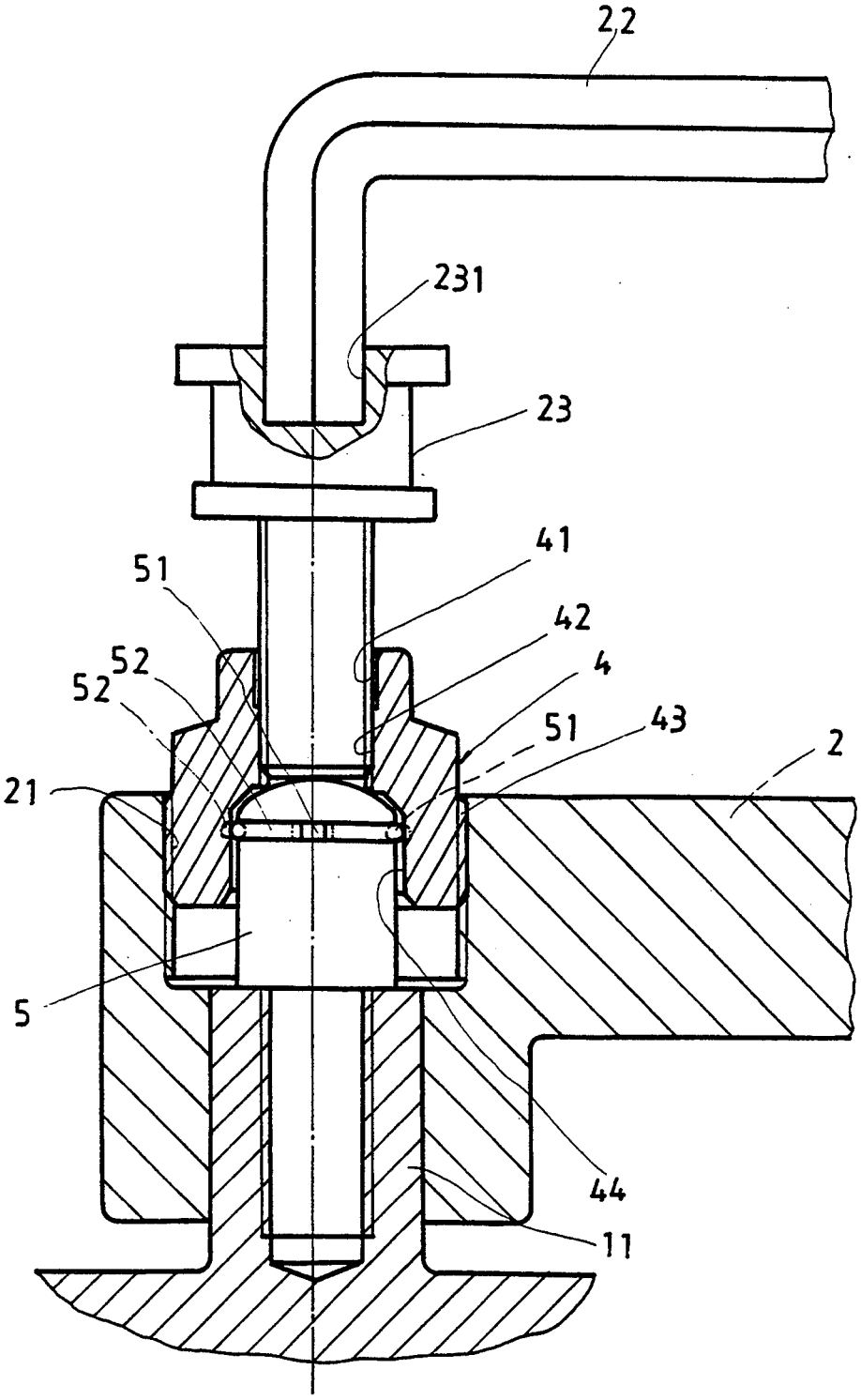
FIG. 3 is a sectional view showing the bicycle pedal crank dismounting device installed.
Figure 4:
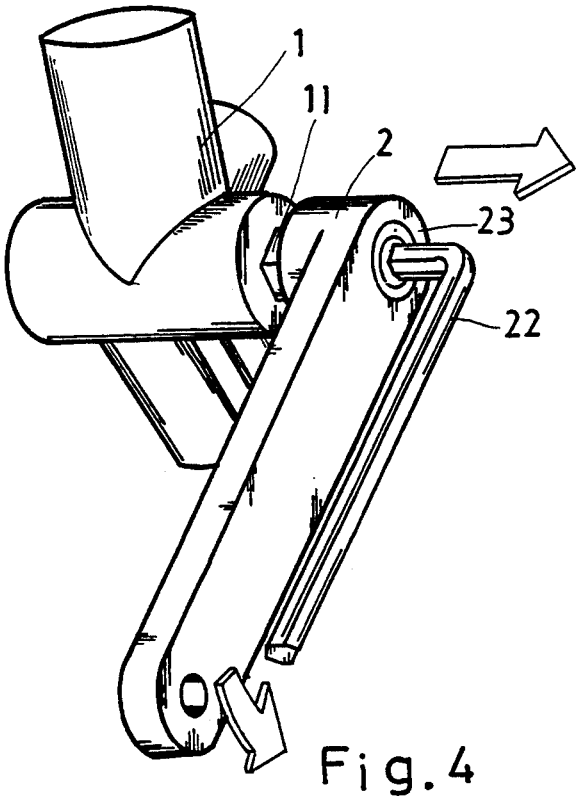
FIGS. 4, 4A, 4B, 4C, and 4D illustrate a series of steps in dismounting the crank of a bicycle pedal from the bottom bracket bearing axle according to the present invention.
Figure 4A:
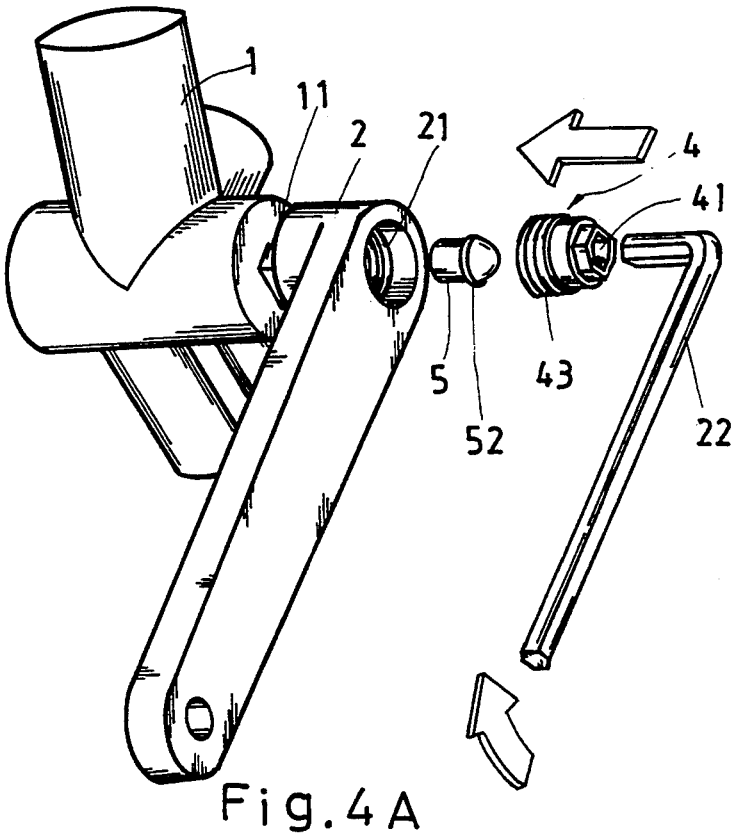
Figure 4B:
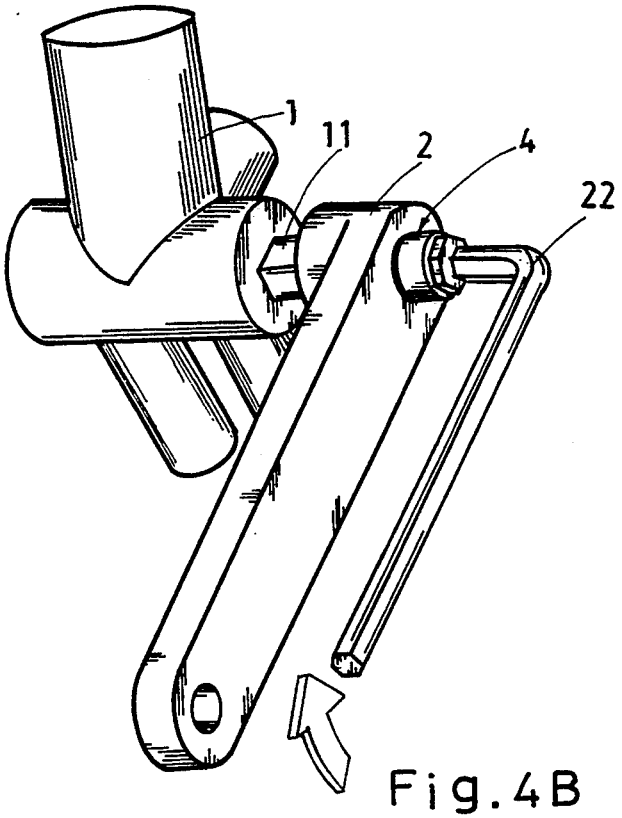
Figure 4C:
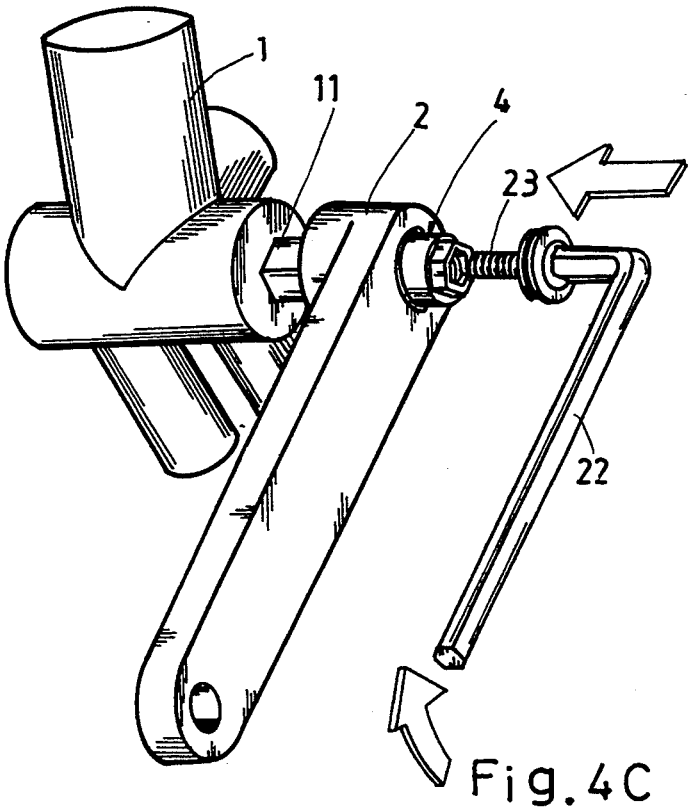
Figure 4D:
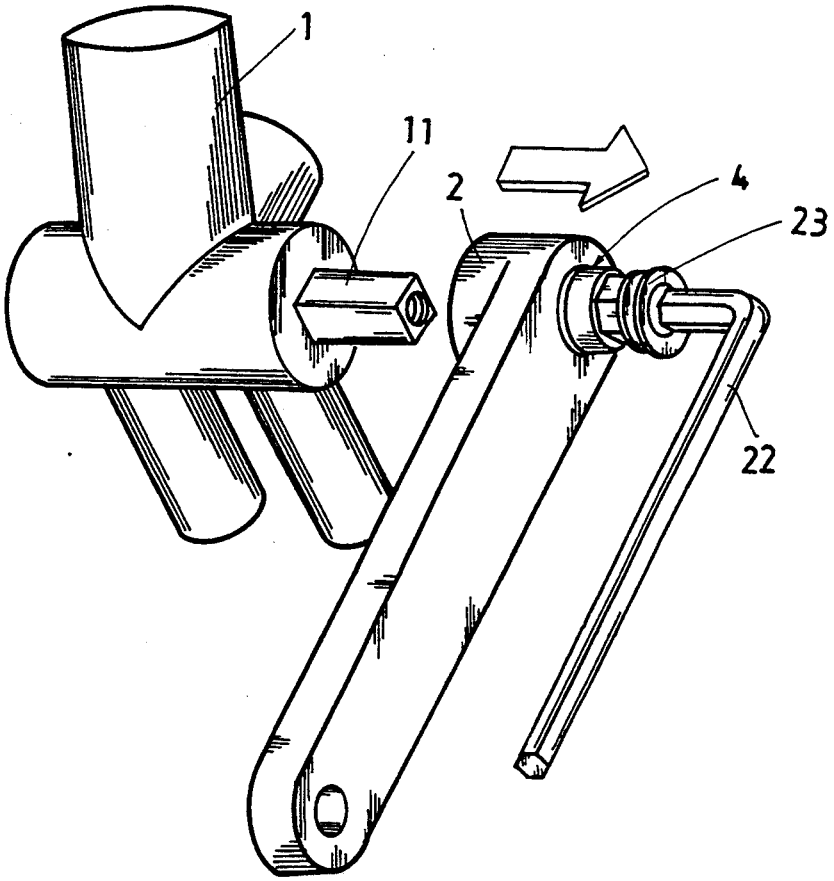

Referring to FIGS. 2 and 3, a hollow, internally threaded screw member 4 is provided comprising an outer thread 43, a hexagonal hole 41 and a circular bottom hole 44 linked by an inner thread 42 thereof and longitudinally aligned through the center in the axial direction. The inner thread 42 of the screw member 4 is to match with the crank lock screw 23. Through the hexagonal hole 41, the screw member 4 can be turned by a L-shaped hexagonal wrench. A stop rod 5 is received in the circular bottom hole 44 of the screw member 4, having an annular groove 51 around the periphery around which a C-shaped retainer ring 52 is fastened to hold the stop rod 5 tight in the circular bottom hole 44 of the screw member 4.

Referring to FIGS. 4, 4A, 4B, 4C, 4D, the crank 2 is dismounted from the bottom bracket bearing axle 11 of the bicycle by: inserting the hexagonal tip of a L-shaped hexagonal wrench 22 into the hexagonal hole 231 on the crank lock screw 23 and then turning the L-shaped hexagonal wrench 22 to remove the crank lock screw 23 from the bottom bracket bearing axle 11, then using the L-shaped hexagonal wrench 22 to drive the stop rod 5 and the screw member 4 into the screw hole 21 of the crank 2 for allowing the stop rod 5 to stop against the bottom bracket bearing axle 11, and then using the L-shaped hexagonal wrench 22 to drive the crank lock screw 23 into the inner thread 42 of the screw member 4 and to turn it round and round so that the screw member 4 is turned in the reversed direction, causing the crank 2 to be simultaneously turned out of the bottom bracket bearing axle 11.

What is claimed is:

1. A bicycle pedal crank dismounting device comprising:

a hollow, internally threaded screw member, said screw member comprising a hexagonal head on one end, an outer thread on an opposite end, a hexagonal hole and a bottom hole linked by an inner thread thereof and longitudinally aligned through the center in the axial direction, the diameter of said bottom hole of said screw member being bigger than said inner thread and hexagonal hole of said screw member, said hexagonal hole being disposed within said hexagonal head, said bottom hole being disposed within said outer thread of said screw member;

a stop rod having one end fastened inside said bottom hole of said screw member and an opposite end extended out of said screw member, said stop rod having an annular groove around the periphery;

a C-shaped retainer ring mounted around said annular groove of said stop rod to fasten said stop rod in said bottom hole of said screw member; and a crank lock screw engaged in a screw hole on a bicycle pedal crank and threaded into a screw hole on a bottom bracket bearing axle of a bicycle to fasten said bicycle pedal crank to said bottom bracket bearing axle, said crank lock screw having a hexagonal hole on a head thereof in size equal to the hexagonal hole on said screw member;

whereby said crank is dismounted from said bottom bracket bearing axle by: using a L-shaped hexagonal wrench to remove said crank lock screw from said bottom bracket bearing axle, then using said L-shaped hexagonal wrench to drive said outer thread of said screw member into the screw hole of said crank for allowing said stop rod to stop against said bottom bracket bearing axle, and then using said L-shaped hexagonal wrench to drive said crank lock screw into the inner thread of said screw member and turn it round and round so as to drive said crank out of said bottom bracket bearing axle in the reverse direction.

* * * * *